US005791624A

United States Patent [19]

Fedrick

[11] Patent Number: 5,791,624

[45] Date of Patent: Aug. 11, 1998

[54] PORTABLE MUSIC DESK

[76] Inventor: Roger Malcolm Fedrick, 6117 Diamond Oaks Ave., Bakersfield, Calif. 93306

[21] Appl. No.: 647,010

[22] Filed: May 9, 1996

[51] Int. Cl.[6] ..... A47B 97/04

[52] U.S. Cl. ..... 248/460; 248/441.1

[58] Field of Search ..... 248/460, 441.1, 248/454, 461, 170; 160/24, 66, 72, 81; 40/607, 658; 84/421, 470 R, 471 R, 472

[56] References Cited

U.S. PATENT DOCUMENTS

| | | | |
|---|---|---|---|
| 132,704 | 10/1872 | White | 248/170 X |
| 227,152 | 5/1880 | Crocker . | |
| 229,622 | 7/1880 | Mansfield | 248/170 X |
| 515,649 | 2/1894 | Brookmire, Jr. . | |
| 1,014,381 | 1/1912 | Force . | |
| 1,364,169 | 1/1921 | Wolff . | |
| 2,873,552 | 2/1959 | Jewell . | |
| 3,313,337 | 4/1967 | Bernat | 160/24 |
| 3,618,885 | 11/1971 | Muller . | |
| 4,068,673 | 1/1978 | Bernardi . | |
| 4,110,003 | 8/1978 | Zinn . | |
| 4,355,779 | 10/1982 | Heled . | |
| 4,561,339 | 12/1985 | Jensen | 248/441.1 X |
| 4,953,609 | 9/1990 | Annin . | |
| 5,636,824 | 6/1997 | Basini et al. | 248/441.1 |

FOREIGN PATENT DOCUMENTS

| | | | |
|---|---|---|---|
| 625300 | 8/1927 | France | 160/24 |
| 1124725 | 3/1962 | Germany | 160/24 |

*Primary Examiner*—Ramon O. Ramirez
*Assistant Examiner*—Long Dinh Phan
*Attorney, Agent, or Firm*—Leo Zucker

[57] ABSTRACT

A portable music desk, including a cylindrical container for storing a length of flexible sheet material. The container has a outer tubular wall with an axially extending slot opening, and an internal winding mechanism for retracting the sheet material through the opening, and for allowing a desired length of the sheet material to extend from the slot opening in the outer tubular wall. A strut arrangement braces the sheet material in a flat and steady work position when the material is extended from the container means, so that the material acts as a back rest surface for a music sheet. A telescoping floor stand is adapted to engage the circumference of the container, and to support the container a desired height above a floor surface.

16 Claims, 6 Drawing Sheets

PORTABLE MUSIC DESK

BACKGROUND OF THE INVENTION

1. Field of the Invention

The present invention relates generally to sheet music desks with floor stands, and particularly to a sturdy, portable music desk and stand that can be disassembled in such a manner as to occupy little space and to facilitate easy storage and transport.

2. Description of the Known Art

U.S. Pat. No. 515,649 (Feb. 27, 1894) discloses a combined music stand and case, including a vertical telescoping shaft. The shaft is collapsible for storage together with three pivoted legs inside a flexible case. The case is locked in cylindrical form with the collapsed shaft and legs inside. When unlocked, the case opens flat to serve as a music rack, by fixing the case at the top of the opened shaft using notched bars pivoted on the back of the case.

U.S. Pat. No. 1,014,381 (Jan. 9, 1912) shows a combined music stand and cylindrical carrying case. A collapsible, flat metal bar desk is supported at the end of telescoping tubes, so that the desk and tubes are insertable through one end of the cylindrical case body. A similar music stand and carrying case is disclosed in U.S. Pat. No. 1,364,169 (Jan. 4, 1921). U.S. Pat. No. 4,355,779 (Oct. 26, 1982) shows a sheet music stand that collapses to a closed position where the stand is held by a strap for storage.

U.S. Pat. No. 4,110,003 (Aug. 29, 1978) relates to a portable movie screen with means for fixing the screen in a flat, unrolled position, and U.S. Pat. No. 4,068,673 (Jan. 17, 1978) shows an awning type sunshade with means for fixing the unrolled shade at an extended position. A combination roll screen and carrying case is shown in U.S. Pat. No. 4,953,609 (Sep. 4, 1990).

There remains today a genuine need for a sturdy, portable music desk and stand that occupy little room when disassembled for storage or transport, and will serve when assembled to hold sheet music steadily in front of a musician whether performing while standing or seated.

SUMMARY OF THE INVENTION

An object of the invention is to provide a portable music desk that offers maximum comfort for a musician.

Another object of the invention is to provide a portable music desk that is capable of disassembly to a compact size for easy transport, and is well-suited for stage, orchestra, brass band, studio or domestic use.

A further object of the invention is to provide a portable music desk which is sturdy, stable and easy to use while maintaining an elegant appearance.

According to the invention, a portable music desk comprises container means for storing a length of flexible sheet material of a certain width, including a generally tubular wall having a slot opening in the axial direction of the wall, and winding means adapted to engage the sheet material for storing the material inside the container means. The winding means has means for retracting the sheet material through the slot opening in the tubular wall, and for allowing a desired length of the sheet material to extend from the slot opening in the outer tubular wall. Strut means braces the sheet material at a work position when the material is extended from the container means, so that the material acts as a back rest surface for a music sheet. Stand means is adapted to engage a part of the container means, and to support the container means a desired height above a floor surface.

For a better understanding of the present invention, together with other and further objects, reference is made to the following description taken in conjunction with the accompanying drawing, and the scope of the invention will be pointed out in the appended claims.

DETAILED DESCRIPTION OF THE INVENTION

Figure 1:
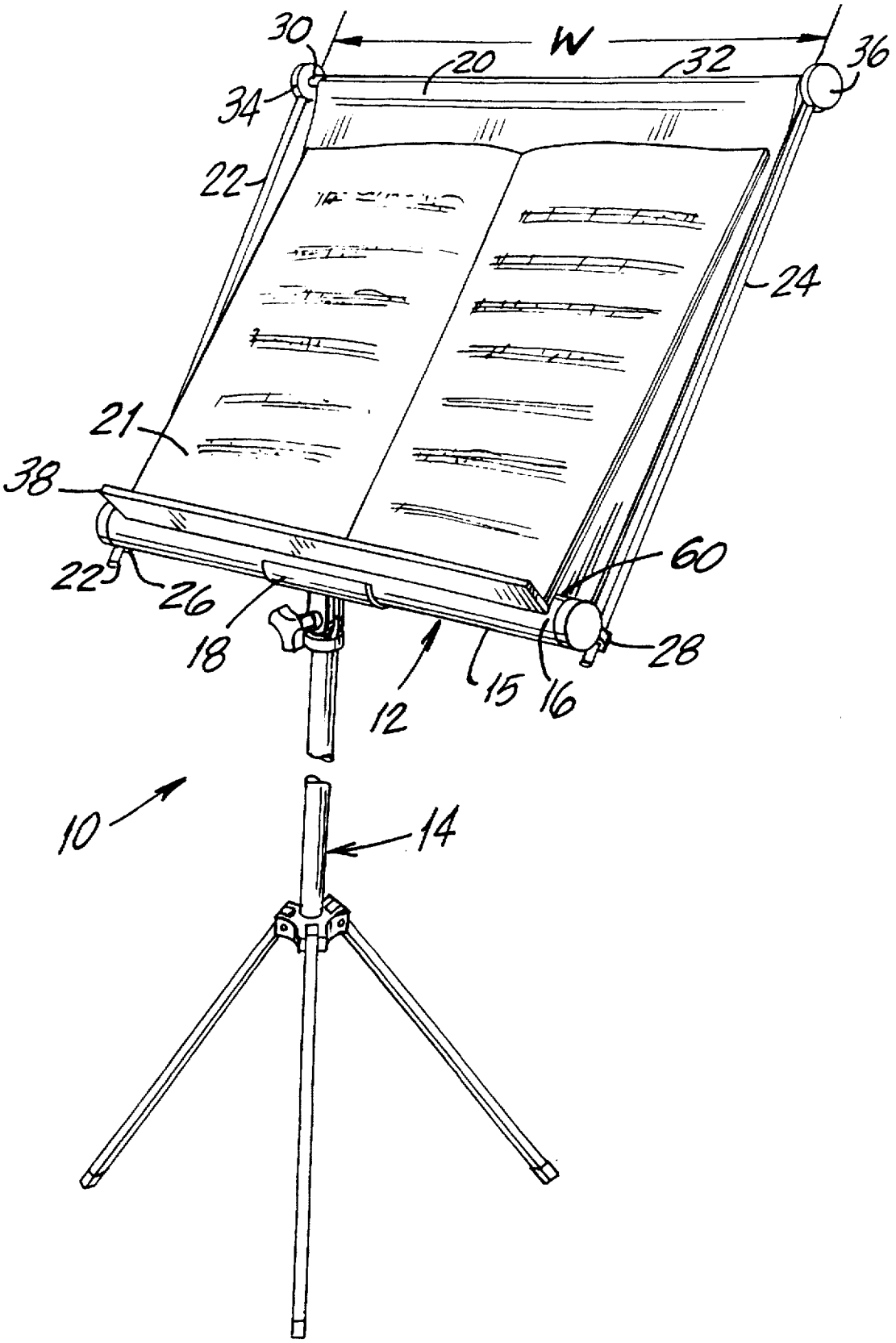
FIG. 1 is a perspective view of an assembled portable music desk with a stand according to the invention.

FIG. 1 is a view of an assembled portable music desk 10, according to the invention. The desk 10 is comprised of a music desk assembly 12 and a collapsible stand 14. The desk assembly 12 comprises a relatively narrow container 15 having a cylindrical outer wall 16 which is supported horizontally by a releasable clamp 18 when the desk 10 is assembled. Further details of the clamp 18 are disclosed in connection with FIG. 7.

A length of flexible sheet material 20 of a certain width W, preferably about 18 inches, extends from the container 15 to form a back rest surface for a music sheet 21. The desk sheet material 20 comprises, for example, canvass that is dyed black or is polyvinyl chloride coated. When the music desk 10 is disassembled for transport or storage, the desk sheet material 20 is retracted inside the container 15 by an internal winding mechanism that applies a retracting force to the material 20. The winding mechanism is described in detail with respect to FIGS. 5 and 6.

After being withdrawn from the container 15 to a length of about 12½ inches, the sheet material 20 is braced steadily at an extended flat work position with respect to the container 15 by a pair of rigid struts 22, 24. The struts may be in the form of, e.g., aluminum rods, and first ends of the struts 22, 24 engage a pair of corresponding 90-degree swivel joints 26, 28 that project rearwardly in FIG. 1 from the container wall 16 near both ends of the container 15. Second ends of the struts 22, 24 opposite the first ends, engage openings in corresponding end parts of a rod 30. The rod 30 traverses a free end portion 32 of the material 20, at which the end portion 32 is folded and sewn over the rod 30. Preferably, the rod 30 has a pair of end caps 34, 36 in which openings for receiving the second ends of the struts 22, 24 are drilled in a radial direction.

Each of the struts 22, 24 preferably exhibits a 90-degree turn relative to the normal direction near the container outer wall 16, either through the swivel joints 26, 28, or by a bend in each strut. Such a bend allows the struts to remain rigid to hold the sheet material 20 at the work position, and enables them to swivel to a storage position parallel to the container axis where they can be strapped for storage. The length of the struts is determined by the fully extended height of the sheet material from the slot in the container 15, and should be such as to brace the material flat and steady enough so that the material can act as a support surface for sheet music.

The struts 22, 24 are of sufficient length, for example, each about 13 inches long, to hold the sheet material 20 at the work position shown in FIG. 1. The second ends of the struts 22, 24 seat firmly in the rod end caps 34, 36 while the sheet material is tensioned by the retracting force of the winding mechanism in the container 15, or by the stiffness of the struts 22, 24 alone.

A music sheet shelf 38 is fixed on the outer periphery of the container 16 in the axial direction. Shelf 38 extends just below and is parallel to an elongate slot 60 in the container outer wall 16, through which slot the sheet material passes. The shelf 38 may be in the form of, for example, an "L"-shaped aluminum channel member.

Figure 2:
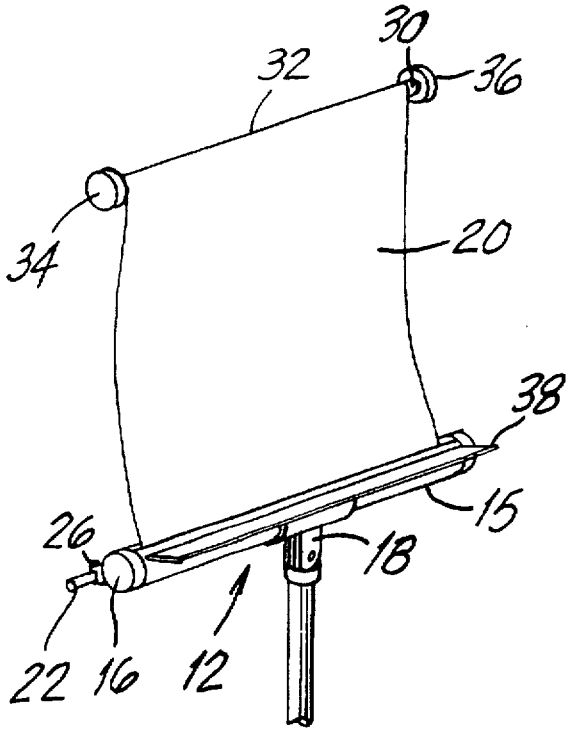
FIG. 2 is a perspective view of the desk in a first stage of disassembly.

FIG. 2 is a view of the desk 10 in a first stage of disassembly. The free end portion 32 of the sheet material 20, is manually pulled away from the container 15 just enough to allow the struts 22, 24 to disengage from the rod 30, and to swivel in the joints 26, 28 on the outer wall 16 to a position where the struts are strapped to the container wall for storage. The struts 22, 24 may be held at the storage position by, e.g., a "Velcro" strap that surrounds the struts and the circumference of the container 15.

Figure 3:
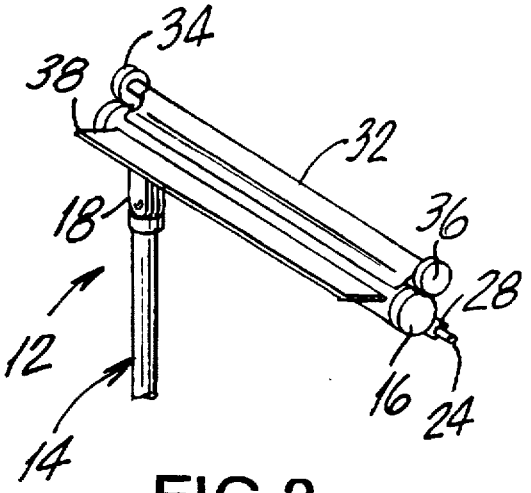
FIG. 3 is a perspective view of the desk in a second stage of disassembly.
Figure 4:
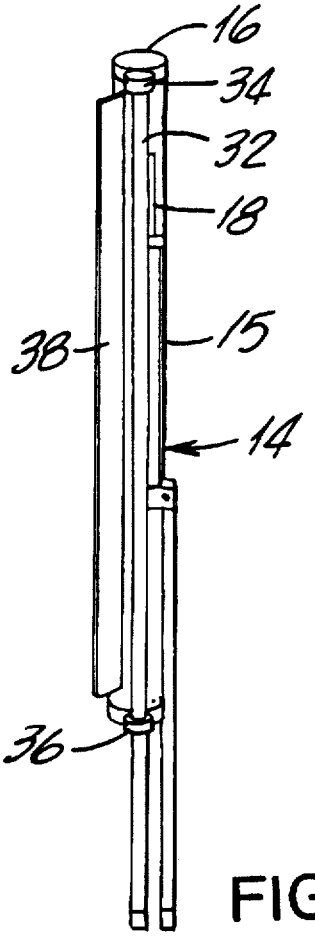
FIG. 4 is a perspective view of the desk in a third stage of disassembly.

FIG. 3 is a view of the desk 10 in a second stage of disassembly. The clamp 18 (see FIG. 7) is loosened enough to allow the container 16, with the sheet material 20 retracted and the struts 22, 24 strapped, to slide in the clamp 18 until the clamp is at one end of the container. The clamp is loosened further to allow the container to pivot downward relative to the stand 14, until the container assumes a vertical position shown in FIG. 4. The clamp 18 is tightened, telescoping pole sections of the stand 14 (see FIG. 9) are collapsed, and the stand legs are swiveled inward. The disassembled music desk 10 then assumes a compact storage or transport configuration in FIG. 4.

Figures 5, 6:
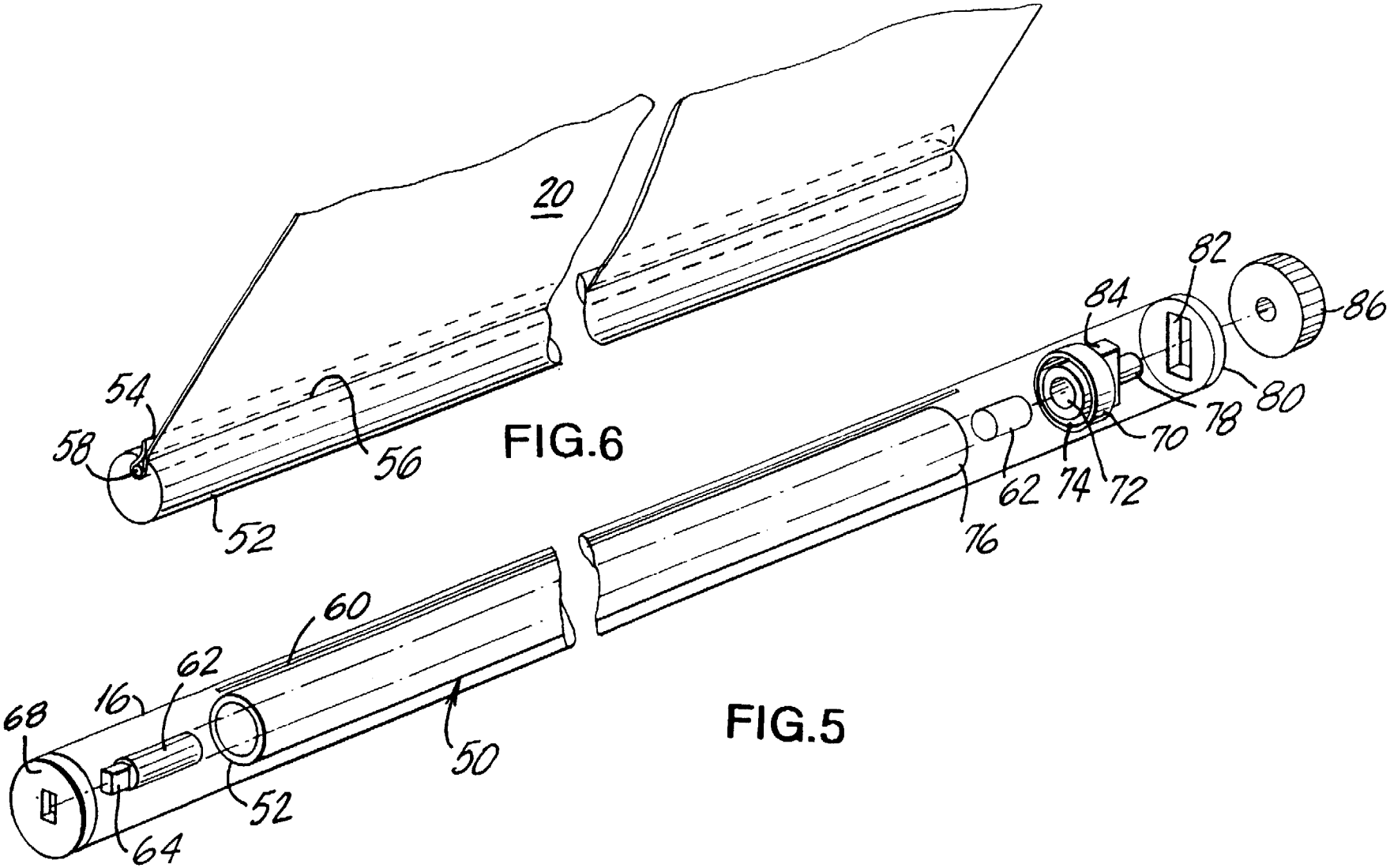
FIG. 5 is a view, partly in section, of a music desk container including an internal winding mechanism.
FIG. 6 is a view of an inside end portion of flexible sheet material that is wound inside the container in FIG. 5.

FIG. 5 is a sectional view of the container 15, showing parts of an internal winding mechanism 50 including a tubular roller 52 that is supported coaxially inside the cylindrical container 15, and about which the sheet material 20 is wound. FIG. 6 is a view of an inside end portion 54 of the sheet material 20. The end portion 54 is joined to the circumference of the roller 52 in the width direction of the material 20. In the illustrated embodiment, roller 52 has an axially extending slit 56, and the end portion 54 of the sheet material passes through the slit 56. The end portion 54 has an end fold that is sewn over a transverse rod 58, and the rod 58 is captured in the material end portion 54 inside the roller 52. The end portion of the sheet material 20 is thus prevented from being pulled free of the roller 52 when the sheet material is fully unwound from the roller wall 52. As noted above, the wall of the container 15 also has an elongate slot 60 in the axial direction, and the sheet material 20 passes through the container slot 60 as it winds on and unwinds from the roller 52 inside the container 15.

Winding mechanism 50, shown in FIG. 5, includes a coil spring arrangement comprised of a torsion spring 62 placed coaxially on a rod 64 that is aligned with the axis of the container 15. One end of the spring 62, shown at the left in FIG. 5, is fixed to the left end of the rod 64, e.g., by locking an end spring winding in a slot cut in a plane that includes the rod axis. The left end of rod 64 has a rectangular profile and engages a corresponding central opening in a left end cap 68 on the container 15. Thus, rod 64 is fixed in position with respect to the container 15.

Except for the left end region of the torsion spring 62, the diameter of spring 62 is sufficiently greater than that of rod 64, so as to permit the spring to be wound a determined number of revolutions while on the rod and without constraint by the rod body.

The torsion spring 62 has a free length that extends beyond the right end of container 15, as viewed in FIG. 5. Spring 62 is, however, maintained in a compressed condition by a winding cap 70 that is disposed in axial alignment with the right end of the fixed container rod 64. The outer diameter of winding cap 70 is such as to permit the cap 70 to turn freely and steadily inside the container 15. Cap 70 also has a central recess opening 72 on one side for engaging a right end portion of the torsion spring 62. The central opening 72 also receives the right end of the fixed rod 64 and maintains same in axial alignment within the container 15, while the cap 70 grips the right end portion of the spring 62 for rotation together about the axis of the rod 64.

Winding cap 70 has an annular recess 74 on the side of the cap 70 facing the spring 62, for engaging and gripping a right end part 76 of the wall of the tubular roller 52. Cap 70 also has an end shaft 78 projecting axially from the side opposite the spring 62. The shaft 78 passes through a center opening in a right end cap 80 fixed on the container 15. End cap 80 has a rectangular recess 82 cut in the side facing the winding cap 70, for receiving a correspondingly shaped protuberance 84 on the winding cap 70. Thus, the winding cap 70 will be locked against rotation on the fixed rod 64 as long as the cap 70 is urged by the spring 62 toward the right in FIG. 5, with the cap protuberance 84 seated in the recess 82 in the fixed end cap 80.

A free end of the shaft 78 projects axially beyond the right container end cap 80, and a thumb wheel 86 is fixed on the shaft 78. End shaft 78 is long enough to permit a determined clearance to exist between opposed faces of the end cap 80 and the thumb wheel 86, so that the wheel 86 can be urged toward the cap 80 against the bias force of the spring 62, to cause the winding cap 70 to disengage the container end cap 80. In such a state, a pre-loaded torsion of the spring 62 is transmitted through the winding cap 70 and roller 52, to apply a retracting force to the sheet material 20. The thumb wheel 86 also can be turned manually, to rotate the winding cap 70 directly in either direction should the torsion spring 62 break or otherwise fail. The rod 30 that traverses the free end portion 32 of the sheet material, has an overall length greater than that of the container slot 60, so that the free end portion of the sheet material can not itself be retracted inside the container 15 by the action of the pre-loaded torsion spring 62.

Figure 7:
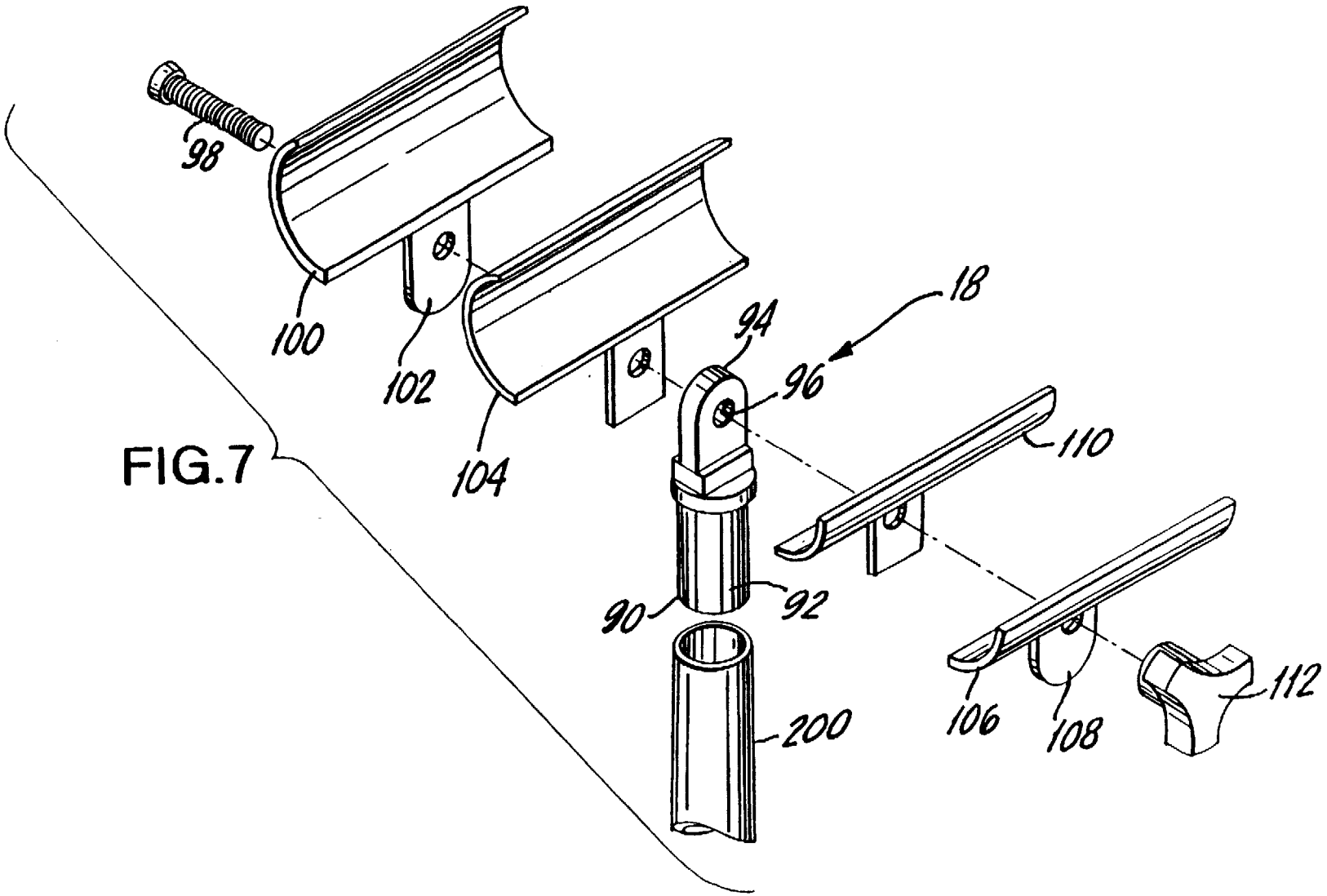
FIG. 7 is an assembly view of a clamp that supports the container in FIG. 5 atop the stand.

FIG. 7 shows details of the releasable container clamp 18. A stem part 90 has a cylindrical neck 92 dimensioned to nest in a top end opening of an upper pole section 200 of the desk stand 14. The stem part 90 has an upper lug 94 formed integrally with the neck 92. The lug 94 has an opening 96 through which a clamping screw 98 passes.

Clamp 18 also includes a first rigid clamp member 100 in the form of a cylindrical section of about a 120-degree arc. Member 100 has a bottom lug 102 with an opening for passage of the clamping screw 98. A relatively soft clamp member insert 104 of rubber or soft plastics material, is provided to enhance grip action of the member 100 and to prevent scratching of the outside surface of the container 15. A second rigid clamp member 106 is in the form of a cylindrical section of about a 45-degree arc. Member 106 also has a bottom lug 108 with an opening for passage of the clamping screw 98. A relatively soft clamp member insert 110 is provided to enhance the grip action of the member 108 and to prevent scratching of the surface of container 15.

Figure 8:
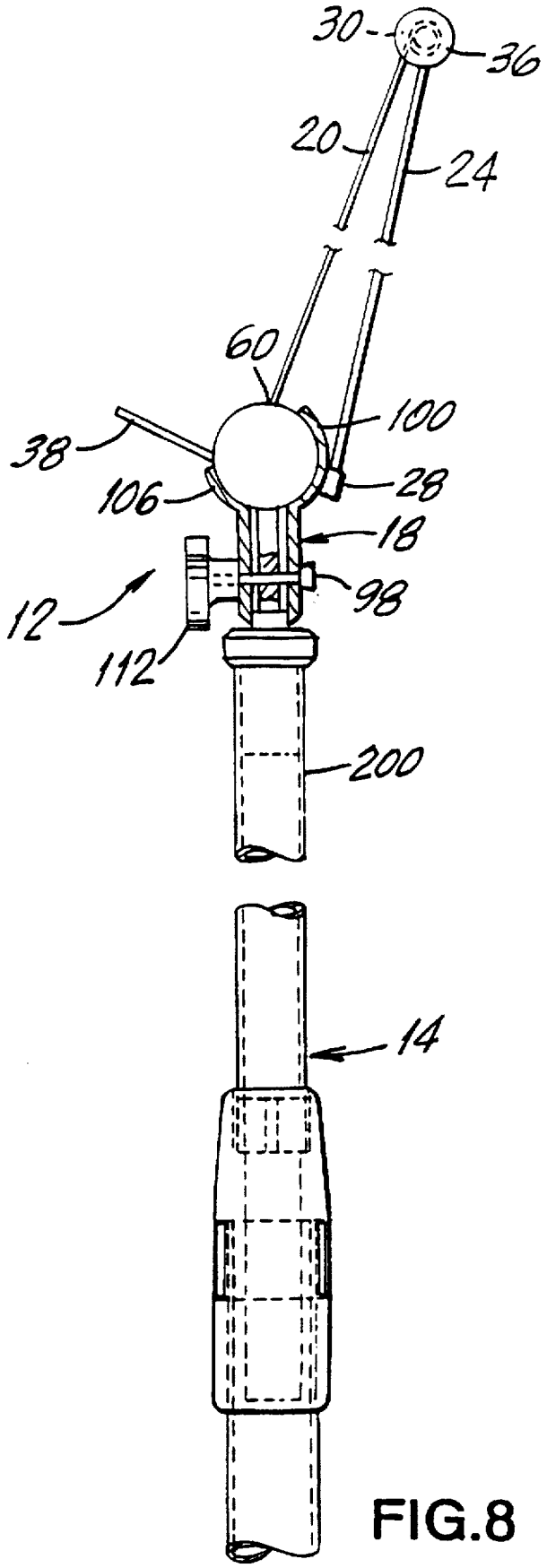
FIG. 8 is an end view of the assembled music desk, showing a relation between the clamp in FIG. 7 and the container in FIG. 5.

The first and the second clamp members 100, 106 are disposed with the corresponding inserts 104, 110 in confronting relation on opposite sides of the lug 94 on the clamp stem part 90. The screw 98 then passes through the openings in the aligned parts, and engages a threaded opening in a knob 112. The music desk container 15 is slid between the opposed clamp members, with the greater, first clamp member 100 against the rear side of the container 15. The lesser second clamp member 108 bears against the front side of the container 15 below the music sheet shelf member 38. See FIG. 8.

Figure 9:
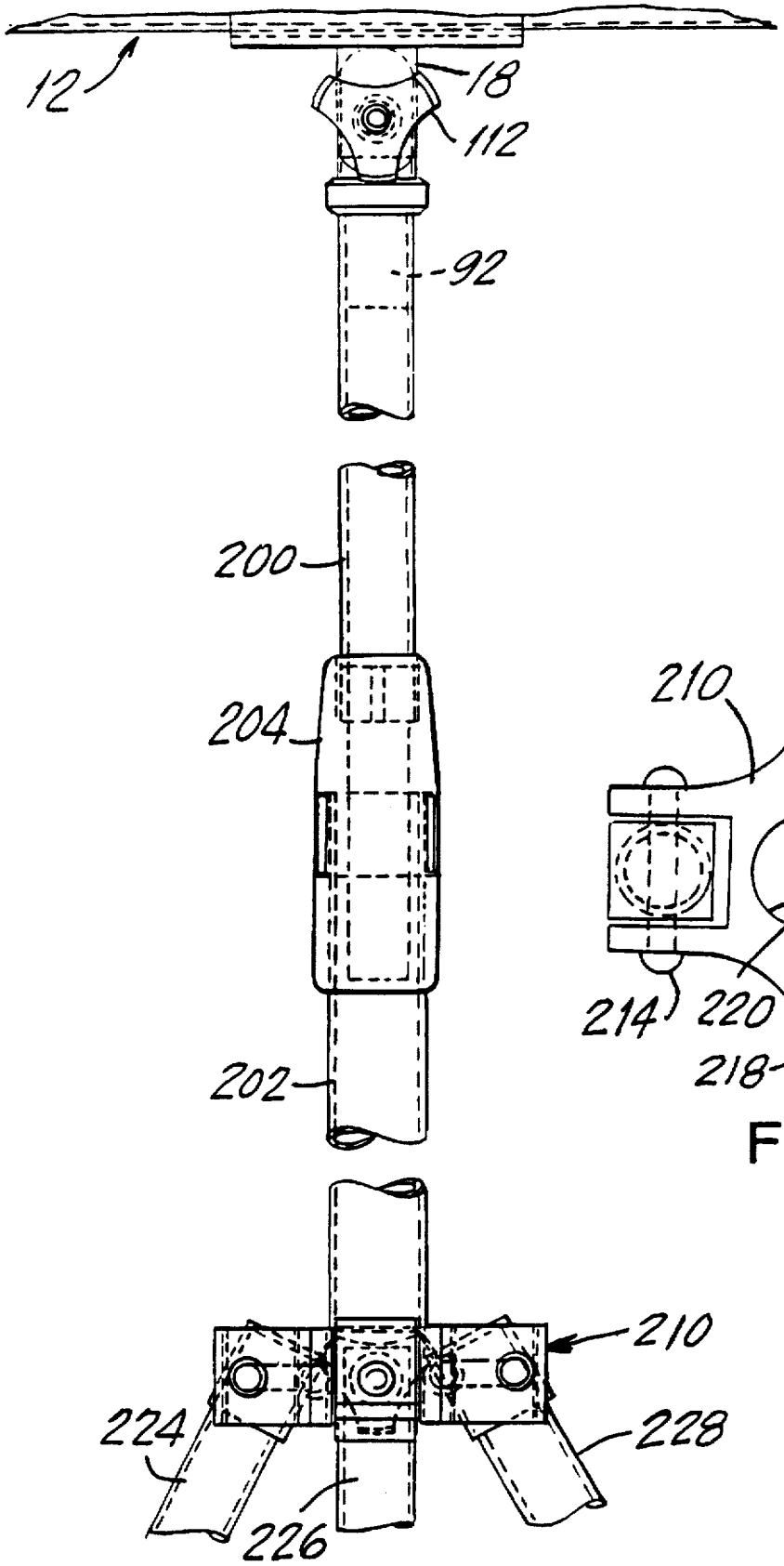
FIG. 9 is an elevational view of the stand.

FIG. 9 is an elevational view of the collapsible stand 14, including telescoping pole sections 200, 202 with a conventional cylindrical locking clamp 204 for fixing the pole sections relative to one another at a desired height. The neck 92 of the music desk clamp 18 is nested in the top opening of upper section 200. Although two pole sections are shown, a third section with a second locking clamp may be provided to allow for a greater maximum height for the desk portion 12 when assembled, while allowing the entire stand 14 to collapse to a size small enough for easy transport and storage.

Figure 10:
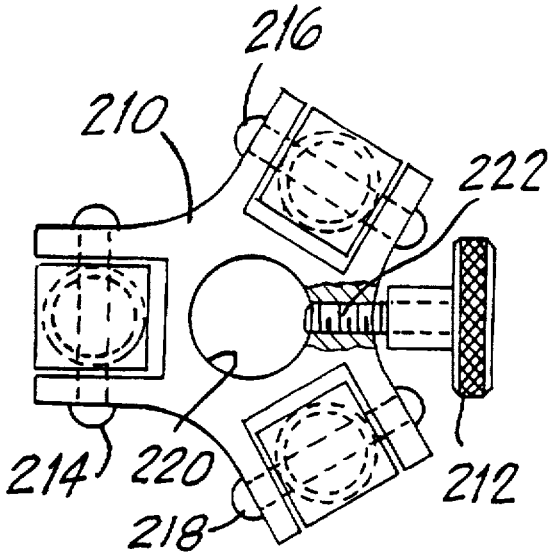
FIG. 10 is a plan view of a stand leg mounting bracket.

A releasable leg bracket 210, shown in plan view in FIG. 10, is slid onto the bottom of the lower pole section 202. The bracket 210 is held firmly in position on the pole section 202 by tightening a thumb wheel screw 212.

The leg bracket 210 is in the form of a "Y" member with a center opening 220. The bracket 210 includes three horizontal pivot shafts 214, 216, 218 in a common plane, and arrayed perpendicular to three equi-angularly spaced radii from the center opening 220. The thumb wheel screw 212 includes a threaded shaft 222 that engages a threaded passage in the hub of the bracket 210, leading to the bracket opening 220. Thus, when the bottom of lower pole section 202 in FIG. 9 is inserted in the bracket opening 220, the bracket can be clamped in place by turning the screw 212 to urge the shaft 222 against the periphery of the pole section 202. Leg bracket 210 can be easily removed by loosening the screw 212 until its shaft 222 separates from the periphery of lower pole section 202.

Each of three stand legs 224, 226, 228 is pivoted at an upper end of the leg on a different one of the shafts 214, 216, 218 of the leg bracket 210. Stand legs 224, 226, 228 may be made of stainless or chrome plated steel tubing, with rubber or plastics caps at both ends of each leg to prevent scratching of the floor surface and to protect the upper ends of the legs in the region of the leg bracket 210. When the legs are swiveled outward, they stand equi-circumferentially spaced from one another on the floor surface.

It is preferred that the stand be adjustable in height from about 70 to 140 centimeters. When the desired height for the music desk is attained, the stand clamp 204 (or clamps) is tightened. A stop (not shown) may also be provided to prevent the stand pole sections from being extended too far apart from one another. The three, rubber-tipped stand legs ensure three-point contact on uneven floors, and prevent chatter when the stand is moved or knocked accidentally. The three-leg arrangement for the stand base will not interfere with a musician's feet.

The stand clamp 18 will hold the music desk assembly firmly in place during use. When the clamp 18 is loosened, it allows the music desk container 15 to pivot and lie parallel to the upper pole of the stand, to assume a storage or transport position. The clamp 18 can be re-tightened to hold the container 15 in the storage position if desired.

While the foregoing description represents a preferred embodiment of the invention, it will be obvious to those skilled in the art that various changes and modifications may be made, without departing from the true spirit and scope of the invention as pointed out in the following claims.

I claim:

1. A portable music desk, comprising;

a container constructed and arranged for storing a length of flexible sheet material of a certain width, including an outer tubular wall having a slot opening in an axial direction of the wall; and a winding mechanism adapted to engage said sheet material for storing the material inside said container, including a roller for retracting said sheet material through the slot opening in said tubular wall, and for allowing a desired length of the sheet material to extend from the slot opening in the outer tubular wall;

at least one strut associated with the container for bracing the sheet material at a work position when the material is extended from the slot opening, so that the material acts as a back rest surface for a music sheet;

a stand assembly for supporting the container a desired height over a floor surface; and a releasable container clamp, part of which clamp is constructed to engage an upper portion of the stand, wherein a clamp member portion of the clamp is configured to grin the outer circumference of the container, and a tightening mechanism associated with the clamp member portion is arranged to tighten the clamp member portion at a desired position along the container including an axial end of the container.

2. A portable music desk according to claim 1, wherein said winding means comprises an inner tubular roller supported coaxially for rotation inside said outer tubular wall, and an inside end portion of the flexible sheet material is fastened to said roller.

3. A portable music desk according to claim 2, wherein said inner tubular roller has a slit opening extending in an axial direction of the roller, and the inside end portion of the flexible sheet material is connected with said roller through said slit.

4. A portable music desk according to claim 2, wherein said winding mechanism includes a spring fixed with respect to the outer tubular wall for applying a torque to said inner tubular roller so that said sheet material is biased to retract inside said outer tubular wall.

5. A portable music desk according to claim 2, including a manual wind mechanism coupled to said inner tubular roller, for allowing said roller to be turned in response to a manually applied torque.

6. A portable music desk according to claim 5, wherein said manual wind mechanism includes a thumb wheel, and the thumb wheel is coupled to said roller.

7. A portable music desk according to claim 1, wherein said strut comprises a rigid strut member arranged to be fixed between said outer tubular wall and a free end portion of said flexible sheet material when said sheet material is at said work position.

8. A portable music desk according to claim 7, including a swivel joint on the outer tubular wall for engaging an end of the strut and for allowing the strut to swivel between a storage position at which the strut extends near the periphery of said outer wall, and a work position at which an opposite end of the strut engages the free end portion of said flexible sheet material.

9. A portable music desk according to claim 8, wherein the free end portion of said flexible sheet material includes a transverse rod member, and said rod member has an end part for engaging the opposite end of said strut when the strut is at said work position.

10. A portable music desk according to claim 9, wherein said end part of said rod member has an opening for receiving the opposite end of the strut member.

11. A portable music desk according to claim 1, wherein said stand includes a vertical pole, and said container clamp has a neck portion formed to engage a top part of the vertical pole.

12. A portable music desk according to claim 11, wherein the clamp member portion of said container clamp is pivotable with respect to said neck portion, so that said clamp member portion can swivel to bring said container while clamped in the clamp member portion to a vertical storage position with respect to the vertical pole of the stand.

13. A portable music desk according to claim 14, wherein the vertical pole of the stand comprises a number of telescoping pole sections.

14. A portable music desk according to claim 11, including three stand leg members, and a leg bracket on said pole for engaging upper end portions of each of said leg members so that said leg members stand equi-circumferentially spaced from one another on the floor surface.

15. A portable music desk according to claim 1, a music sheet support on the container for holding a music sheet in place while resting against the extended sheet material.

16. A portable music desk according to claim 15, wherein said sheet support comprises an elongate angle member joined to the periphery of said outer tubular wall beneath the slot opening in the outer wall.

* * * * *